US009945537B2

(12) United States Patent
Campbell et al.

(10) Patent No.: US 9,945,537 B2
(45) Date of Patent: Apr. 17, 2018

(54) LIGHT DEFLECTOR

(71) Applicants: Michael Campbell, Dallas, TX (US); Barry Pickles, Allen, TX (US)

(72) Inventors: Michael Campbell, Dallas, TX (US); Barry Pickles, Allen, TX (US)

( * ) Notice: Subject to any disclaimer, the term of this patent is extended or adjusted under 35 U.S.C. 154(b) by 0 days.

(21) Appl. No.: 15/012,217

(22) Filed: Feb. 1, 2016

(65) Prior Publication Data

US 2016/0223163 A1 Aug. 4, 2016

Related U.S. Application Data

(60) Provisional application No. 62/109,849, filed on Jan. 30, 2015.

(51) Int. Cl.
*F21V 11/16* (2006.01)
*F21S 8/02* (2006.01)

(52) U.S. Cl.
CPC ..... *F21V 11/16* (2013.01); *F21S 8/026* (2013.01)

(58) Field of Classification Search
CPC ..... F21V 11/16; F21S 8/026
See application file for complete search history.

(56) References Cited

U.S. PATENT DOCUMENTS 4,779,178 A 10/1988 Spitz
5,062,030 A 10/1991 Figueroa
5,274,533 A 12/1993 Neary et al.
5,803,585 A 9/1998 Littman et al.
6,260,982 B1 7/2001 Huebner
6,942,364 B1 9/2005 Wegner et al.
7,568,818 B2 8/2009 Pfund
8,292,456 B2 10/2012 Kong
8,662,695 B2 3/2014 Wilson
2002/0191400 A1 12/2002 Jilk et al.
2007/0103894 A1* 5/2007 Klose ..... F21S 8/026 362/147
2010/0009621 A1* 1/2010 Hsieh ..... F21V 33/0096 454/293
2010/0188851 A1 7/2010 Sims
2014/0003040 A1* 1/2014 Holman ..... F21K 9/52 362/147

* cited by examiner

*Primary Examiner* — Thomas M Sember

(74) *Attorney, Agent, or Firm* — Jack D. Stone, Jr., Esq.; Scheef & Stone, L.L.P.

(57) ABSTRACT

A deflector controls the distribution of light emanating from an overhead light fixture defining at least two opposing first edges connected by at least two opposing second edges, the at least two first edges and at least two second edges substantially defining a rectangle. A panel is defined by at least two opposing horizontal edges and two opposing vertical edges to substantially form a rectangle. One of the horizontal edges is secured to a selected first edge of the light fixture with the panel hanging downwardly from the selected first edge of the light fixture, the selected first edge of the light fixture being located between the light fixture and an area where reduced light is desired.

18 Claims, 4 Drawing Sheets

LIGHT DEFLECTOR

CROSS-REFERENCE TO RELATED APPLICATIONS

This application claims the benefit of U.S. Provisional Application No. 62/109,849, filed Jan. 30, 2015, which application is hereby incorporated herein by reference, in its entirety.

TECHNICAL FIELD

The invention relates generally to overhead light and, more particularly, to an apparatus and method for controlling the distribution of light emanating from a recessed light fixture by deflecting light away from an area where reduced light is desired.

BACKGROUND

In overhead light fixtures, such as fluorescent light fixtures recessed in a ceiling, excessive light spills over into areas undesirable from an aesthetic aspect. Manufacturers have attempted to cure this problem by mounting a lens diffuser within the light fixture. Such a diffuser, however, still allows light to be broadcast in all directions.

SUMMARY

The present invention, accordingly, provides an apparatus for controlling the distribution of light emanating from an overhead light fixture defining at least two opposing first edges connected by at least two opposing second edges, the at least two first edges and at least two second edges substantially defining a rectangle. A panel is defined by at least two opposing horizontal edges and two opposing vertical edges to substantially form a rectangle. One of the horizontal edges is secured to a selected first edge of the light fixture with the panel hanging downwardly from the selected first edge of the light fixture, the selected first edge of the light fixture being located between the light fixture and an area where reduced light is desired.

The horizontal edge of the panel secured to a selected first edge of the light fixture preferably includes a lip that engages the selected first edge of the light fixture, further securing the panel in place.

The panel preferably further includes a side panel extending from each vertical edge of the panel to a respective second edge of the light fixture.

An advantage of the invention is that the panel may be mounted on the exterior of a light fixture, and can be retrofitted, for example, on existing recessed fluorescent light fixtures for controlling the distribution of light from an overhead light fixture.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
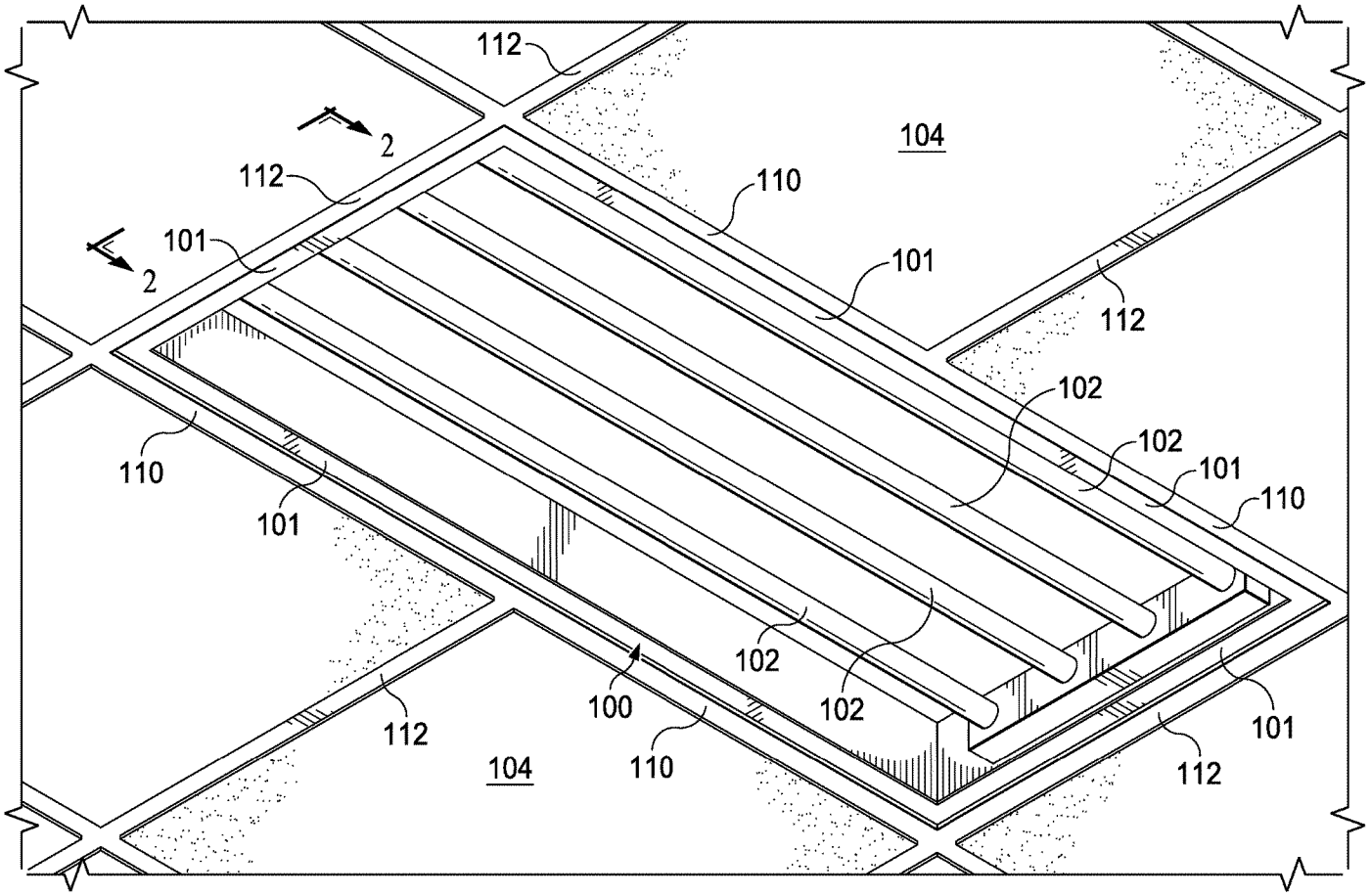
FIG. 1 (PRIOR ART)
FIG. 1 is a perspective view of a light fixture according to the prior art.

Refer now to the drawings wherein depicted elements are, for the sake of clarity, not necessarily shown to scale and wherein like or similar elements are designated by the same reference numeral through the several views. Additionally, as used herein, the term "substantially" is to be construed as a term of approximation.

For definitional purposes, the following terms will be used for referring to the fully assembled system in normal use. The term "horizontal" refers to the direction parallel to a surface on which the assembled shelving system is supported in normal use. The term "vertical" refers to a direction substantially perpendicular to the horizontal direction.

Referring to FIG. 1 of the drawings, the reference numeral 100 generally designates a light fixture embodying features of the prior art. Fluorescent bulbs 102 are typically mounted within light fixture 100, such as a fixture recessed within a ceiling, such as a dropped ceiling 104. In a dropped ceiling, the light fixture includes a perimeter frame 101 supported by longitudinal channels 110 and latitudinal channels 112 in a manner well known in the art. While the light sources are depicted as fluorescent bulbs, it is understood that the light sources may be otherwise, such as light emitting diode (LED) strip lights, incandescent bulbs, and the like.

Figure 2:
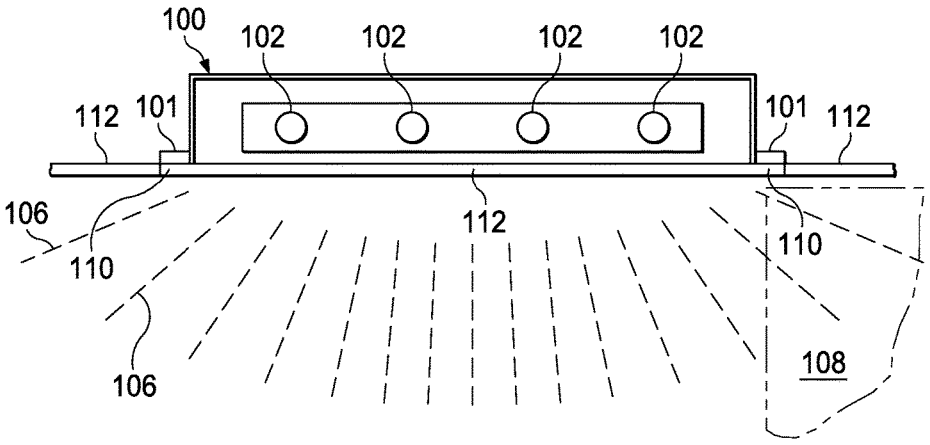
FIG. 2 (PRIOR ART)
FIG. 2 is an end view, taken along line 2-2 of FIG. 1, showing the emanation of light from the prior art light fixture of FIG. 1.

FIG. 2 is an end view of prior art light fixture 100, taken along line 2-2 of FIG. 1, exemplifying light rays 106 generally emanating from the light fixture. The reference numeral 108 represents an area in which reduced light is desired. It is clear that the prior art fixture 100 broadcasts light to the area 108. Such light fixtures are considered to be well known in the art and so will not be described in further detail herein.

Figure 3:
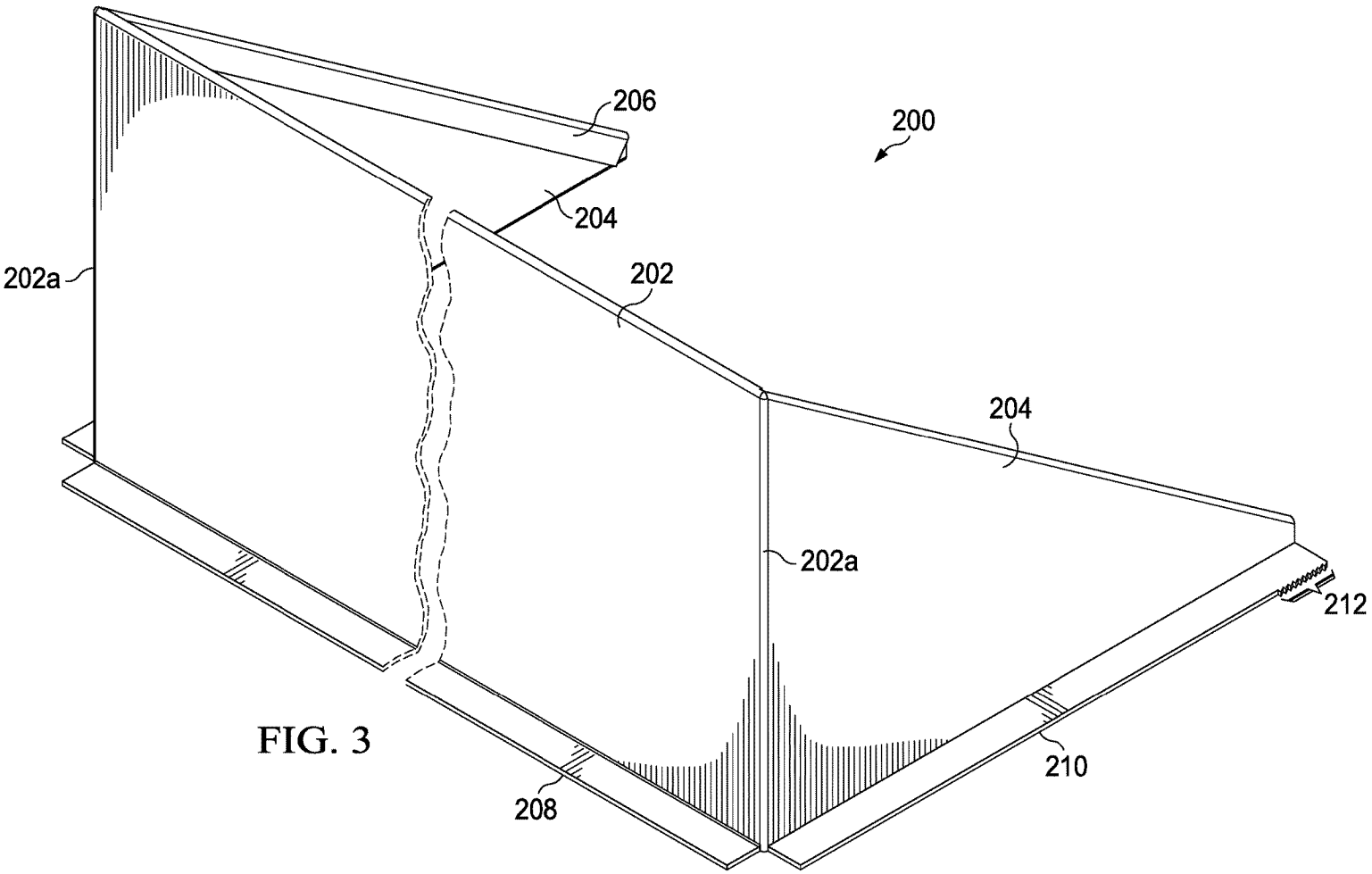
FIG. 3 is a perspective view of a deflector embodying features of the present invention.

FIG. 3 exemplifies a deflector 200 having a front panel 202 and side panels 204 extending from respective vertical edges 202*a* of the front panel substantially perpendicularly to the front panel. Front panel 202 preferably includes a lip 208 extending substantially perpendicularly from front panel 202, and each side panel 204 preferably includes a lip 210, similar to lip 208, extending substantially perpendicularly from respective side panels 204. It will be appreciated with respect to FIGS. 4 and 5 that lips 208 and 210 further preclude light from entering area 108. Front and side panels 202 and 204 and lips 208 and 210 preferably include folded edges (e.g., 206 in FIG. 3) to avoid sharp edges. One end of each lip 210 preferably includes at least a portion 212 of which is serrated to assist in maintaining the deflector in place by creating a partial locking connection between the two metal edges 212 and 101. Front and side panels 202 and 204 and lips 208 and 210 are preferably fabricated from a single piece of sheet metal, of suitable thickness, well known in the art.

Figure 5:
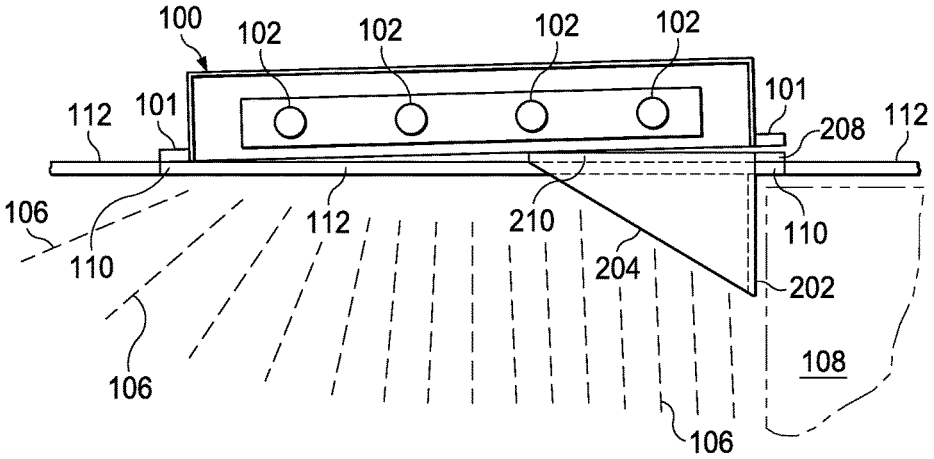
FIG. 5 is an end view, taken along line 5-5 of FIG. 4, showing how the emanation of light is re-directed using the deflector of FIGS. 3 and 4 mounted as depicted in FIG. 4.
Figure 4:
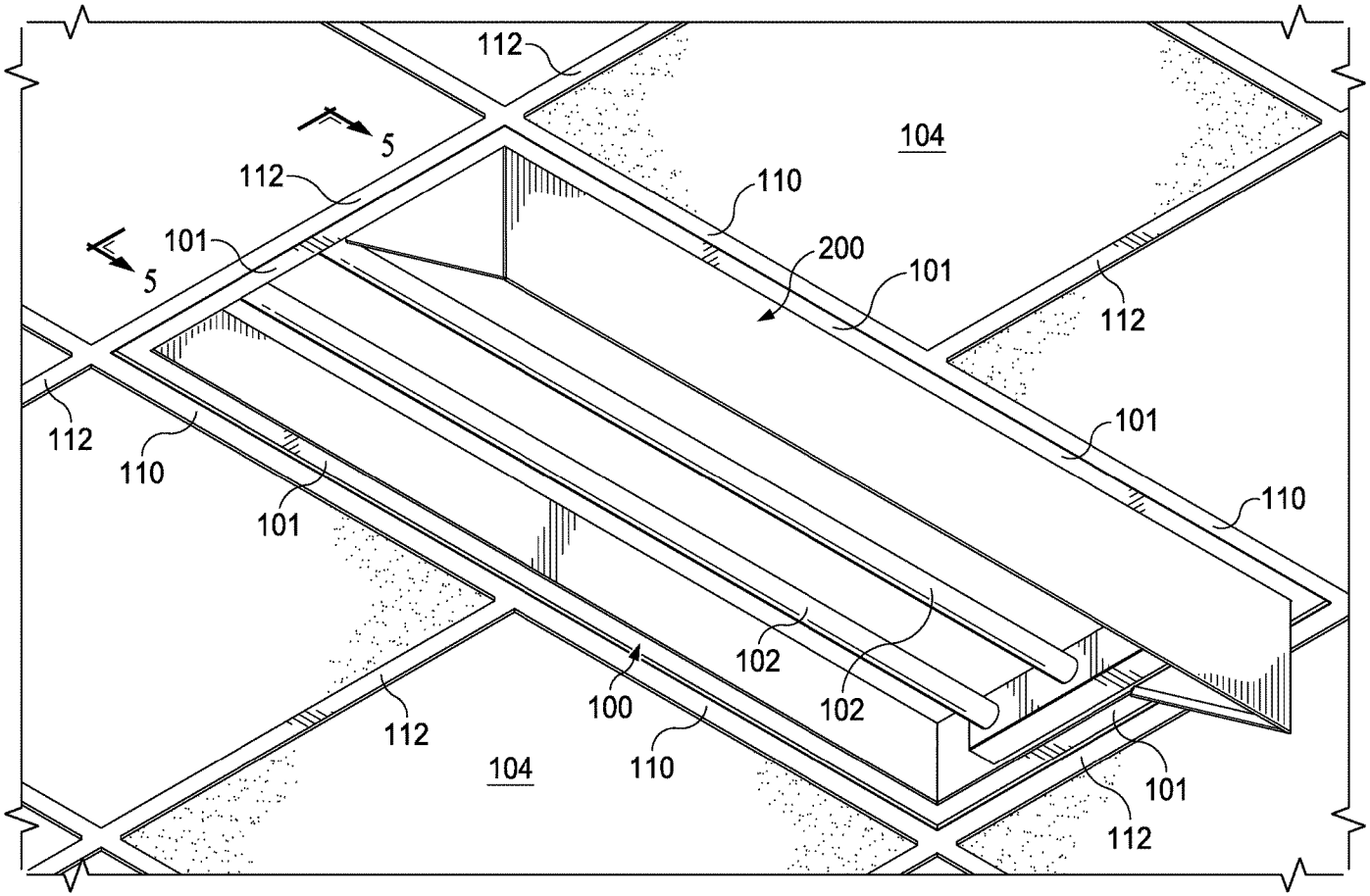
FIG. 4 is a perspective view of an exemplary light fixture including the deflector of FIG. 3.

FIG. 4 depicts deflector 200 mounted on light fixture 100 recessed in a dropped ceiling, and FIG. 5 depicts an end view of deflector 200 taken along line 5-5 of FIG. 4. As shown most clearly in FIG. 5, lip 208 rests on a longitudinal channel 110, and lips 210 rest on latitudinal channels 112. The light fixture 100 is supported in the ceiling 104 by perimeter frame 101, and the perimeter frame is configured to rest on channels 110 and 112, and on lips 208 and 210 where deflector 200 is positioned. It can be appreciated that the thickness of lips 208 and 210 has been exaggerated in FIG. 5 for effect, and that in operation the perimeter frame 101 of light fixture 100 will rest more squarely on lips 208 and 210 than is shown in FIG. 5. As further shown in FIG. 5, light emanating from light fixture 100 is reduced in area 108.

It is understood that the present invention may take many forms and embodiments. Accordingly, several variations may be made in the foregoing without departing from the spirit or the scope of the invention. For example, deflector 200 could be fabricated from other materials, such as poly resign using a 3D laser printer. Deflector 200 could be used in numerous other applications, such as art framing material, or it could be used to deflect conditioned air from a heating and/or air conditioning outlet or vent.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A deflector for controlling the distribution of light emanating from an overhead light fixture, the fixture defining at least two opposing first edges connected by at least two opposing second edges, the at least two first edges and at least two second edges substantially defining a rectangle, the deflector comprising:

a panel defined by at least two opposing horizontal edges and two opposing vertical edges to substantially form a rectangle, wherein one of the horizontal edges is configured to be secured to a selected first edge of the light fixture with the panel hanging downwardly from the selected first edge of the light fixture, the selected first edge of the light fixture being located between the light fixture and a selected area where reduced light is desired so that, when light emanates from the light fixture, the panel blocks at least a portion of the light directed to the selected area.

2. The deflector of claim 1 wherein the panel is a front panel and the deflector further comprises two side panels extending from respective vertical edges of the front panel to respective second edges of the light fixture.

3. The deflector of claim 1 wherein the panel is suspended substantially vertically downwardly from the selected first edge of the light fixture.

4. The deflector of claim 1 wherein the selected area is below the light fixture.

5. The deflector of claim 1 wherein the panel is a front panel and the deflector further comprises two side panels extending perpendicularly from respective vertical edges of the front panel to respective second edges of the light fixture.

6. The deflector of claim 1 wherein the panel is a front panel and the deflector further comprises two substantially triangular side panels extending perpendicularly from respective vertical edges of the front panel to respective second edges of the light fixture.

7. The deflector of claim 1 wherein the panel is a front panel, and the deflector further comprises two side panels extending from respective vertical edges of the front panel to respective second edges of the light fixture, and wherein each side panel further includes at least one respective second lip further extending substantially perpendicularly from a respective side panel and configured for being secured to a second edge of the light fixture.

8. A deflector for controlling the distribution of light emanating from an overhead light fixture, the fixture defining at least two opposing first edges connected by at least two opposing second edges, the at least two first edges and at least two second edges substantially defining a rectangle, the deflector comprising:

a front panel defined by first and second opposing horizontal edges and two opposing vertical edges to substantially form a rectangle, wherein the first horizontal edge further includes at least one first lip extending substantially perpendicularly from the front panel and is configured for being secured to a selected first edge of the light fixture with the front panel hanging downwardly from the selected first edge, the selected first edge being located between the light fixture and a selected area where reduced light is desired; and wherein the deflector further comprises two side panels extending from respective vertical edges of the front panel to respective second edges of the light fixture, and wherein each side panel further includes at least one respective second lip further extending substantially perpendicularly from a respective side panel and configured for being secured to a second edge of the light fixture.

9. The deflector of claim 8 wherein at least a portion of the at least one respective second lip further includes a serrated edge for further securing the deflector to the light fixture.

10. The deflector of claim 8 wherein the panel is suspended substantially vertically downwardly from the selected first edge of the light fixture.

11. The deflector of claim 8 wherein the selected area is below the light fixture.

12. The deflector of claim 8 wherein the panel is a front panel and the deflector further comprises two side panels extending perpendicularly from respective vertical edges of the front panel to respective second edges of the light fixture.

13. The deflector of claim 8 wherein the deflector further comprises two substantially triangular side panels extending perpendicularly from respective vertical edges of the front panel to respective second edges of the light fixture.

14. A method for controlling the distribution of light emanating from an overhead light fixture, the fixture defining at least two opposing first edges connected by at least two opposing second edges, the at least two first edges and at least two second edges substantially defining a rectangle, the method comprising:

hanging a front panel substantially downwardly from a first edge of the light fixture so that when light emanates from the light fixture, the panel blocks at least a portion of the light directed to a selected area; and hanging from second edges of the light fixture two side panels extending from respective vertical edges of the front panel.

15. The method of claim 14 wherein the selected area is below the light fixture.

16. The method of claim 14 wherein the two side panels extend perpendicularly from respective vertical edges of the front panel to respective second edges of the light fixture.

17. The method of claim 14 wherein the two side panels are two substantially triangular side panels extending perpendicularly from respective vertical edges of the front panel to respective second edges of the light fixture.

18. The method of claim 14 wherein the front panel is substantially rectangular.

* * * * *